US006691601B2

(12) United States Patent
Cohen et al.

(10) Patent No.: US 6,691,601 B2
(45) Date of Patent: Feb. 17, 2004

(54) PERSONAL PROTECTIVE SHIELD

(75) Inventors: Avi Cohen, deceased, late of Carmiel (IL), by Iris Cohen, Moran Cohen, Kfir Cohen, Elad Cohen, legal representatives; Baruch Shahar, Haifa (IL); Baruch Trattner, Haifa (IL)

(73) Assignee: Rafael-Armament Development Authority Ltd., Haifa (IL)

( * ) Notice: Subject to any disclaimer, the term of this patent is extended or adjusted under 35 U.S.C. 154(b) by 0 days.

(21) Appl. No.: 09/768,399

(22) Filed: Jan. 24, 2001

(65) Prior Publication Data

US 2002/0092416 A1 Jul. 18, 2002

Related U.S. Application Data

(63) Continuation of application No. 09/580,847, filed on May 30, 2000, now abandoned.

(30) Foreign Application Priority Data

May 31, 1999 (IL) ..... 130204

(51) Int. Cl.[7] ..... F41H 5/08

(52) U.S. Cl. ..... 89/36.05; 89/36.01; 89/36.07; 109/49.5

(58) Field of Search ..... 89/36.05, 36.01, 89/36.07, 36.02, 36.06; 109/49.5; 402/26; 16/277, 282, 297, 300; 403/43, 53, 61, 64, 68

(56) References Cited

U.S. PATENT DOCUMENTS

| | | | | | |
|---|---|---|---|---|---|
| 36,781 | A | * | 10/1862 | Hunter | 109/22 |
| 1,110,084 | A | * | 9/1914 | Szalkay | 160/219 |
| 1,273,371 | A | * | 7/1918 | Hudziak | 109/49.5 |
| 1,287,695 | A | * | 12/1918 | Jezowski | 109/49.5 |
| 1,294,191 | A | * | 2/1919 | Suderlock | 160/135 |
| 1,304,541 | A | * | 5/1919 | Clark | 89/36.09 |
| 2,020,702 | A | * | 11/1935 | Russell | 89/36 |
| 3,762,345 | A | | 10/1973 | Sgariglia, Jr. | 109/22 |
| 4,412,495 | A | | 11/1983 | Sankar | 109/49.5 |
| 4,782,735 | A | | 11/1988 | Mui et al. | 89/36.07 |
| 5,293,807 | A | * | 3/1994 | Hajdu | 89/36.7 |
| 5,641,934 | A | * | 6/1997 | Follett | 89/36.05 |
| 5,850,052 | A | * | 12/1998 | Gabriel | 89/36.05 |
| 5,970,843 | A | * | 10/1999 | Strasser et al. | 89/36.02 |
| 6,009,789 | A | * | 1/2000 | Lyons | 89/36.02 |
| 6,314,858 | B1 | * | 11/2001 | Strasser et al. | 89/36.02 |

FOREIGN PATENT DOCUMENTS

| | | | | |
|---|---|---|---|---|
| DE | 4207811 | | 9/1993 | F41H/5/08 |
| JP | 6137793 | A * | 5/1994 | 89/36.05 |

* cited by examiner

*Primary Examiner*—Charles T. Jordan
*Assistant Examiner*—Gabriel S Sukman
(74) *Attorney, Agent, or Firm*—Merchant & Gould P.C.

(57) ABSTRACT

A personal protective shield, which comprises a central panel; at least two lateral panels; and hinged connections between the central panel and the lateral panels. The protective shield has a folded configuration for carrying it and for attaching to it other equipment, in which the aforementioned lateral panels are folded against the central panel, and an expanded configuration for carrying out its protective function, in which the aforementioned lateral panels are angularly set off from the central panel. The central panel and the lateral panels are made of bulletproof plate materials. The central panel may have a curved configuration adapted to fit the back of the user, and the lateral panels may have curved configurations matching that of the central panel.

27 Claims, 20 Drawing Sheets

PERSONAL PROTECTIVE SHIELD

This application is a continuation of Ser. No. 09/580,847 filed May 30, 2000 now abandoned.

FIELD OF THE INVENTION

This invention relates to personal shields for protecting military personnel against projectiles of small caliber or projectile fragments, which shield constitutes or can support as carriage- or carrying system or be integrated with a rucksack or other equipment item.

BACKGROUND OF THE INVENTION

The protection of military personnel against projectiles fired by small arms, such as handguns, has been considered by the prior art and several devices have been disclosed for this purpose.

U.S. Pat. No. 4,412,495 discloses a total body protective device which includes a pair of fabric panels made of bullet-proof material, handles on an upper part of the apparel piece for holding the device in front of a person and a window through the top panel piece for observing an assailant, which shield can be stored in rolled-up condition for placement near the door of a person's residence, or which can be carried outdoor by a pedestrian, similarly to a cane. Such a device, while possibly useful for defense against an assailant in a street, cannot be carried and used by military personnel in the field.

U.S. Pat. No. 3,762,345 discloses an attache case that can be used in the conventional manner for transporting personal effects, but which additionally functions as an armor shield to protect the user from projectiles fired by handguns. At the time of use, an armor assembly is expanded from a compacted nested arrangement, to an expanded configuration that increases the surface area of the protective shield. This shield, too, is not useful for soldiers in the field, as a soldier must carry regular equipment and cannot, additionally, carry an attache case.

U.S. Pat. No. 4,782,735 discloses an inflatable bulletproof shield or mattress, which can be carried in portable fashion in a stored condition within a small case having a source of pressurized gas. This device, too, is clearly not adapted for use by military personnel.

DE 4,207,811 discloses a portable protective shield for the protection of persons against shrapnel and bullets, which comprises a bulletproof visor, several openings for action that may be closed with shutters, and several means for carrying it. The means for carrying the shield would interfere with carrying arms or other equipment, and therefore this shield is not adapted for military personnel.

It is seen, therefore, that the prior art does not provide a personal shield that can be carried by military personnel, without interference with other items of equipment that may have to be carried, and can be used as a defense against projectiles of small caliber or projectile fragments.

It is a purpose of this invention to provide a personal protective shield against bullets fired from small arms or shrapnel, or at any rate, small projectiles or fragments of projectiles, which can be carried by military personnel in the same way in which equipment, such as, e.g., a rucksack, is usually carried, and therefore be easily transported from one location to another and quickly used when needed; and additionally can support a rucksack or other container or equipment attached to it.

It is another purpose of this invention to provide such a shield that is comfortable to carry, and has limited dimensions and weight.

It is a still further purpose of this invention to provide such a shield that can offer protection over a surface and along angles that can be changed according to circumstances.

It is a still further purpose of this invention to provide such a shield that can offer particular protection to the head of the user.

It is a still further purpose of the invention to provide such a shield that has a carrying configuration and an operative configuration and can be shifted from one another with great speed and ease.

It is a still further purpose of this invention to provide such a shield that is simple and inexpensive.

Other purposes and advantages of the invention will appear as the description proceeds.

SUMMARY OF THE INVENTION

The protective shield according to the invention comprises:

a)—a central panel, preferably having a configuration adapted to fit the back of the user;

b)—at least two lateral panels;

c)—hinged connections between said central panel and said lateral panels;

d)—said protective shield having a configuration (hereinafter, "the folded" or "closed" configuration) for carrying it and for attaching to it other equipment as carriage, in which the aforesaid lateral panels are folded over the said central panel, and a configuration (hereinafter, "the expanded" or "open" configuration) for carrying out is protective function, in which the aforesaid lateral panels are angularly set off from said central panel; and e)—the central panel and the lateral panels being of bulletproof materials.

The shield is provided with carrier attachments, e.g. straps and buckles, for carrying it on the user's back, which can be called "front" or "primary" carrier attachments. Preferably, other carrier attachments, e.g. straps and buckles, are provided for removably connecting to the shield a rucksack or other container or item of equipment, when the shield is in the folded configuration. They may be called "secondary" or "rear" carrier attachments. All of said attachments can vary, depending on the particular way in which the shield is used and on the nature of the other items of equipment, if any. They can be easily provided by skilled persons and need not be particularly described.

In a first form of the invention, all the panels are of plate material and the hinged connections between the central panel and the lateral panels have at least two degrees of liberty, so that the lateral panels, in the expanded configuration, may be set at the sides of the central panel in a vertical position, to protect the sides of the user, or may be set at the top of the central panel in a horizontal position, to protect the user's head.

In a second form of the invention, the central and lateral panels are of plate materials; the lateral panels, in the expanded configuration, are set at the sides of the central panel in a vertical position, to protect the sides of the user; and the shield further comprises a flexible top piece, which is folded, in the closed configuration, vertically against the folded lateral panels, and in the expanded configuration, assumes an inverted-U configuration over and around the head of the user.

The two degrees of liberty of the hinged connections, particularly in said first form invention, are preferably obtained by a novel structure of hinges, which is in itself a part of the invention. Said structure comprises:

1—a corner piece, comprising two pins extending from it at right angles to one another;

2—two plates, for rigid connection to two members to be hinged to one another;

3—for each plate, a knob solid with or rigidly connected to the plate, having a cylindrical seat for one of said pins and having serrations adapted to be engaged by said pin on its end surface proximate to said corner piece; and 4—means for elastically retaining said knob against said corner piece.

The terms "front" and "back" of the central panel, or "in front of" and "behind", refer the folded configuration of the shield and its configuration when carried on the user's back.

The central panel is preferably shaped to match the shape of the user's back, having at all points the appropriate curvature. The lateral panels are at least two or maybe more, and have shapes corresponding to the shape of said central panel. Nevertheless, the panel curvatures, if any, are not too sharp, and reference may be made hereinafter to "the plane" of a panel, meaning the plane that most approximates the curved shape of the panel. The central and the lateral panels can also be flat, without any curvature, in which case the expression "the plane of the panel" will have the customary meaning.

The hinged connections provide two degrees of liberty since they permit rotation about at least two, preferably perpendicular, axes. Said axes are preferably, but not exclusively, one a vertical and the other a horizontal axis. The terms "vertical" and "horizontal", too, refer the folded configuration of the shield and its configuration when carried on the user's back. As will be seen, in the aforesaid first form of the invention, when the shield is opened to the expanded configuration, the central panel is rotated by 90 degrees, while the lateral panels may assume different orientations. In the aforesaid second form of the invention, it remains on the wearer's back and the central panel does not change its position.

Preferably, locking means are provided for removably connecting the two lateral panels together, when the shield is in the folded configuration. Said lateral panels, when they are in the folded configuration, are preferably folded over and are in contact with the central panel, and they are located in front of said central panel. Therefore, in this configuration, the user's back is in contact with the front of the lateral panels in the first form of the invention, while in the second form of the invention it is in contact with the folded top piece. In every case, the central panel is located behind the lateral panels and in contact with the items removably connected to it. To avoid uncomfortable contact of the lateral panels with the user's back, when they are in the folded configuration, any suitable padding may be provided, as will be better explained hereinafter. The top piece, when present, may carry out this function.

Preferably, the angles made by the lateral panels with the central panel, in plan view, when the shield is in its expanded configuration, which is also the operative or protective configuration, may be right angles or other angles, preferably larger than 90°.

In the first form of the invention, the lateral panels may be placed at an angle, generally of 90°, to the central panel, when seen in vertical view, and thus, the lateral panels may be vertical or horizontal or in part vertical and in part horizontal, when the shield is in the open configuration. Therefore, while there may be one or more than one folded configuration, there a plurality of possible expanded configurations.

The carrier attachments for carrying the shield on the user's back ("main" or "front" carrier attachments) are preferably straps, more preferably, adjustable by conventional means by which straps are adjusted, e.g., by means of suitable buckles such as used for tightening safety belts.

Preferably, the central panel is provided with a handle or other means for carrying it by hand, as if it were a bag, instead of on the user's back.

The central and lateral panels are preferably made of bullet-proof, substantially rigid, plate material. Said plate material may be a solid plate, e.g., of polyethylene, or a composite material of fibers in a plastic matrix. Non-limiting examples of fiber material are polyethylene, aramide, glass, carbon, and ceramics. Non-limiting examples of matrix material are thermosetting resins like epoxy, phenolics, polyesters etc. and thermoplastic resins like polyolefins, polyamides, polyesters, poly-ether-ether-ketone etc. The plates may preferably have a thickness from 3 to 25 mm. Preferably, the protective shield is painted with camouflage patterns.

The preferred dimensions of the protective shield are as follows: for the central panel, a height from 50 to 80 cm, and a width from 30 to 45 cm; for the lateral panels, the same width as the central panel, and a height which may very, in the various embodiments, from that of the central panel to one-half thereof. The terms "height" and "width" refer to the folded configuration of the shield and its configuration when carried on the user's back.

DETAILED DESCRIPTION OF PREFERRED EMBODIMENTS

Figure 1:
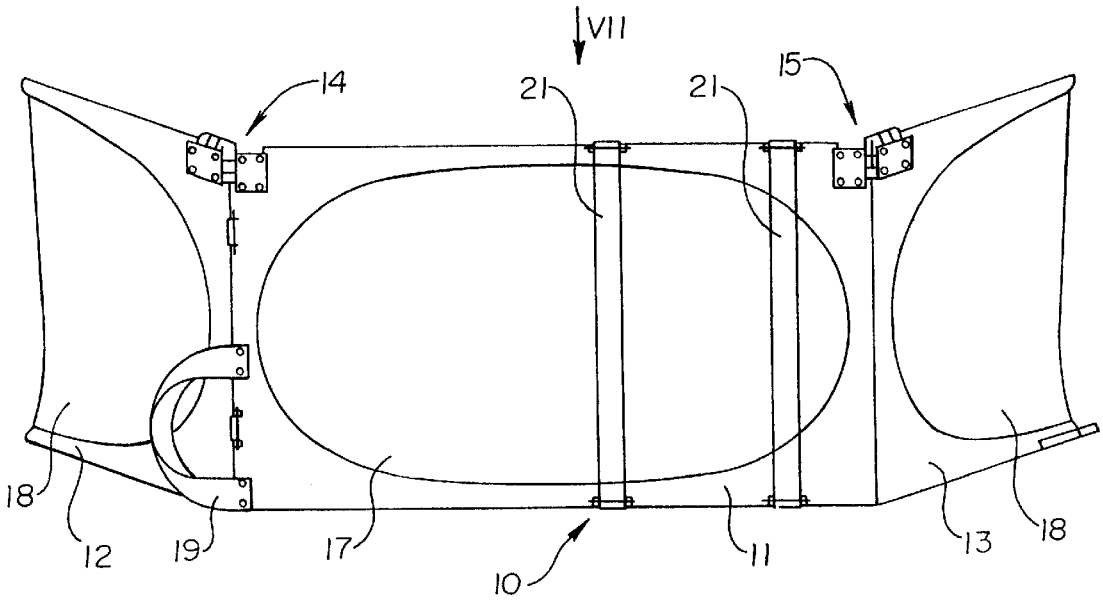
FIG. 1 is a perspective view, from the rear, of a shield according to an embodiment of the invention, shown in an expanded configuration in which the lateral panels are vertical and at an angle of about 120° from the central panel.

FIG. 1 shows the protective shield, according to an embodiment of the invention, in an expanded configuration, in which it gives extensive protection in the horizontal plane, the protection in the vertical plane being limited to a height which is the width of the panels. "Width" means herein the lateral or horizontal dimension of the panels when the shield is in closed configuration and carried on the user's back. The shield, generally indicated at 10, comprises a central panel 11 and two lateral panels 12 and 13. It is seen that the center line of the central panel, which is vertical in the folded configuration of the shield (See FIG. 3), is horizontal in this configuration. Area 17 of the central panel is a convexity due to the curvature of the panel to fit the back of the user. Areas 18 are concavities of the lateral panels due to their curvatures matching that of the central panel. In the expanded Configuration of FIG. 1, the lateral panels are slanted to the outside and to the rear, which is the side at which the user will place himself. 14 and 15 generally indicate two hinges joining the lateral panels to the central panel at their upper edges, preferably having two degrees of liberty, and more preferably structured as illustrated in FIGS. 9 to 15, to be described hereinafter. It must be understood, however, that, while said most preferred hinges are comprised in the invention, they do not limit it, and a great variety of connections providing two degrees of freedom can be used by skilled persons without departing from the invention.

Figure 3:
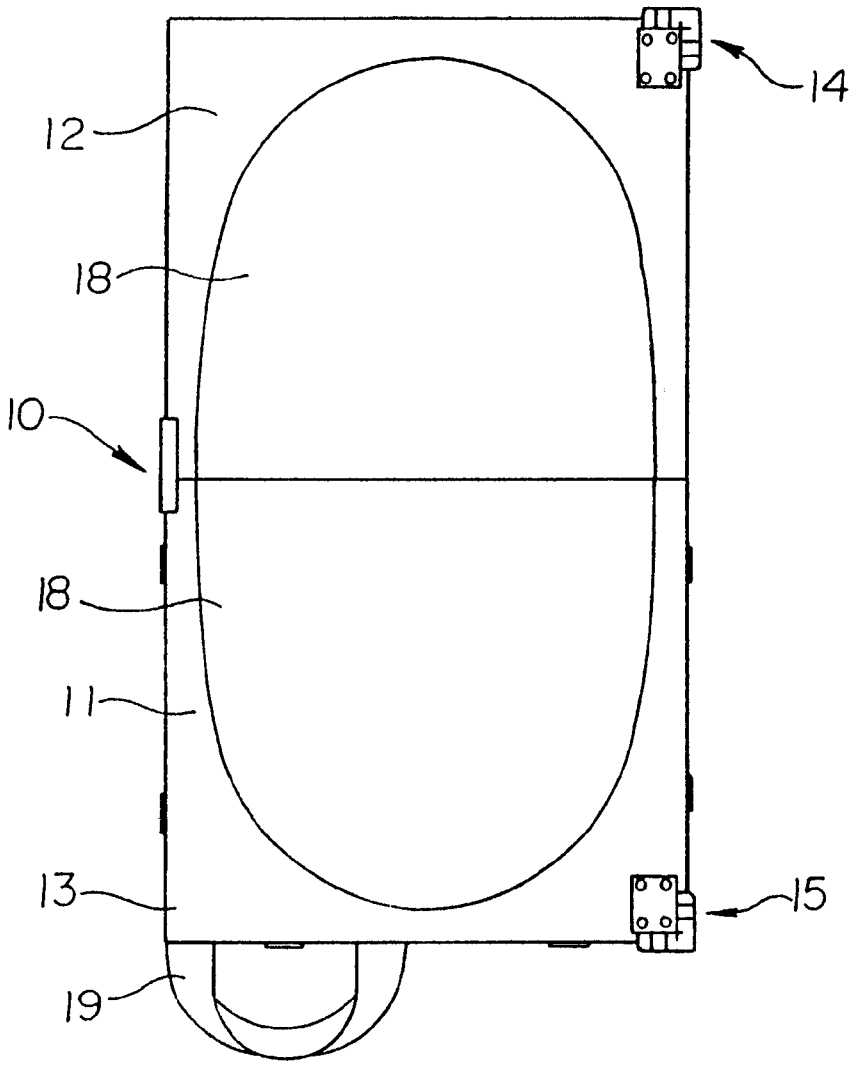
FIG. 3 is a front view of the shield seen in the folded configuration.

Numeral 21 generally indicates straps which can be tightened by means of buckles, not illustrated, for fixing a rucksack or other items to the rear of the protective shield. For this purpose, as seen in the drawing, the straps 21 are located not in the center but near one end of the central panel, which will be the upper end, when the shield is carried on the user's body, as seen in FIG. 3. Numeral 19 indicates a flexible handle, made of fabric or other material, for carrying the shield when in the folded configuration of FIGS. 3 and 4.

Figure 2:
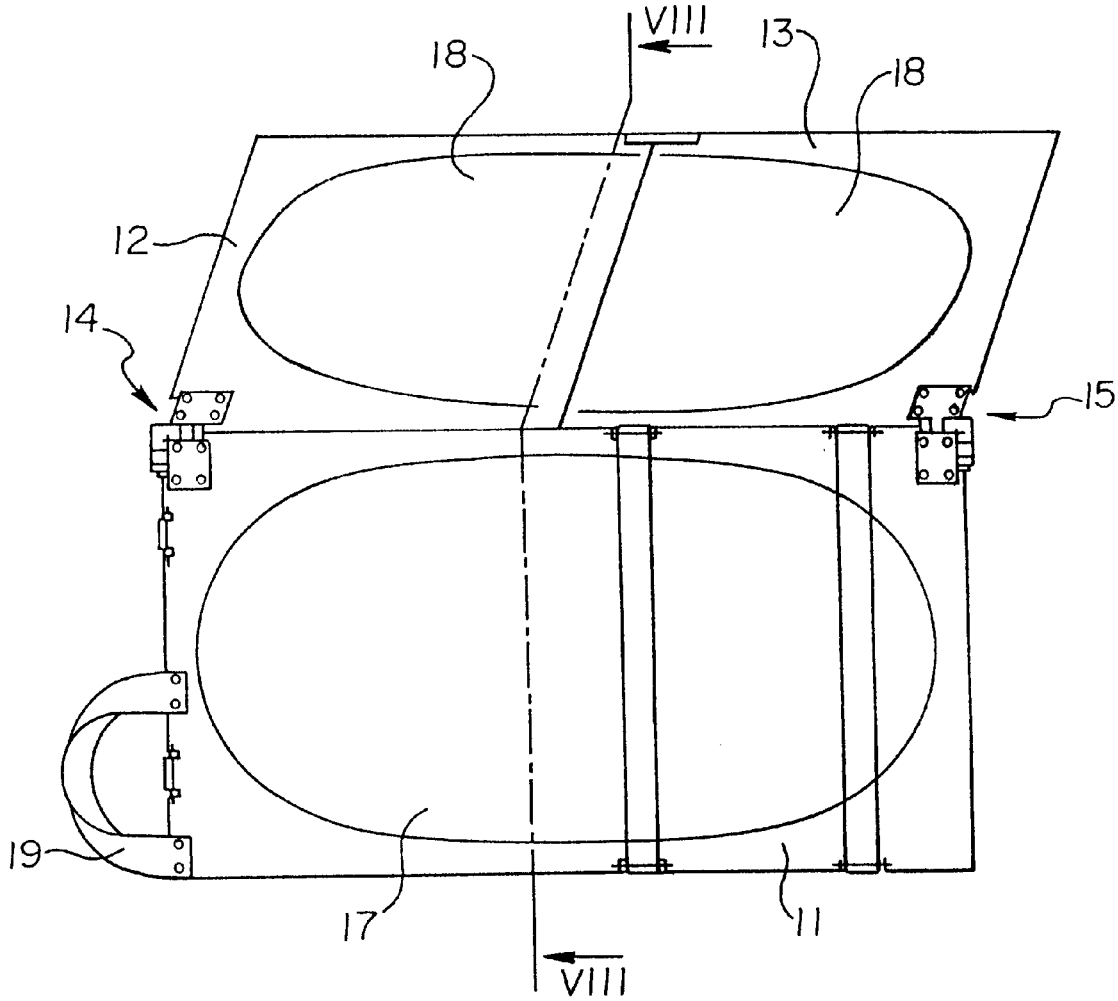
FIG. 2 is a view from the rear of the protective shield in another expanded configuration, in which the lateral panels are disposed horizontally.

FIG. 2 shows another expanded configuration of the shield, in which the lateral panels 12 and 13 are placed horizontally, to afford protection to the user's head. When hinges such as those illustrated in FIGS. 9 to 15 are used, they hold the lateral panels horizontal in the operative configuration of FIG. 2, as will be explained. However, other means for this purpose can be easily devised by skilled persons.

Figure 4:
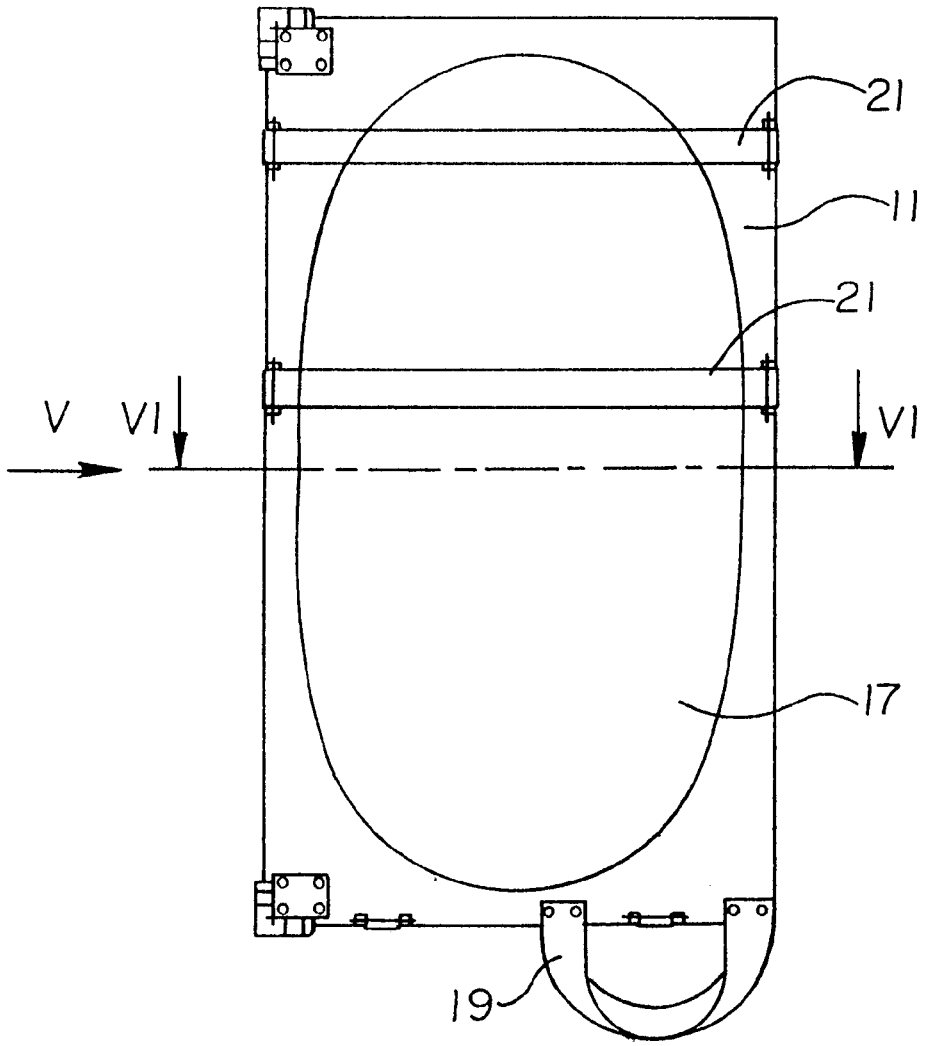
FIG. 4 is a rear view of the shield seen in the folded configuration.
Figure 5:
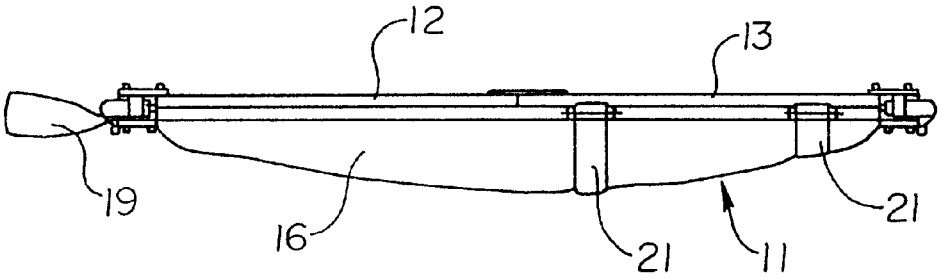
FIG. 5 is a top view of the shield illustrated in FIG. 4.
Figure 6:
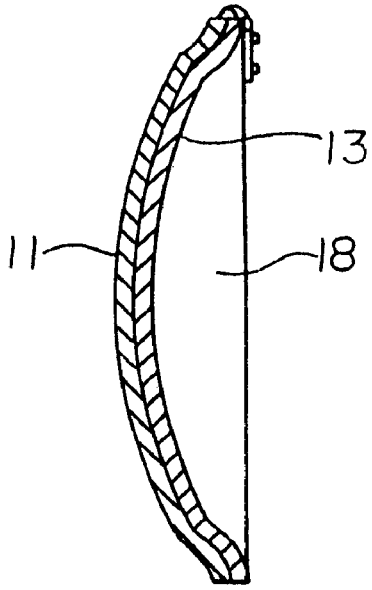
FIG. 6 is a cross-section of the shield in the folded configuration, taken along plane VI—VI of FIG. 4.
Figure 7:
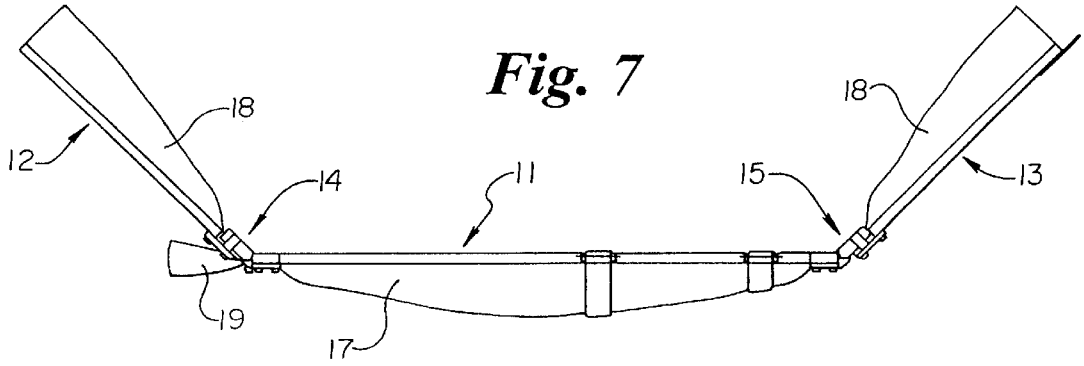
FIG. 7 is a top view of the shield illustrated in FIG. 1 in the expanded configuration.
Figure 8:
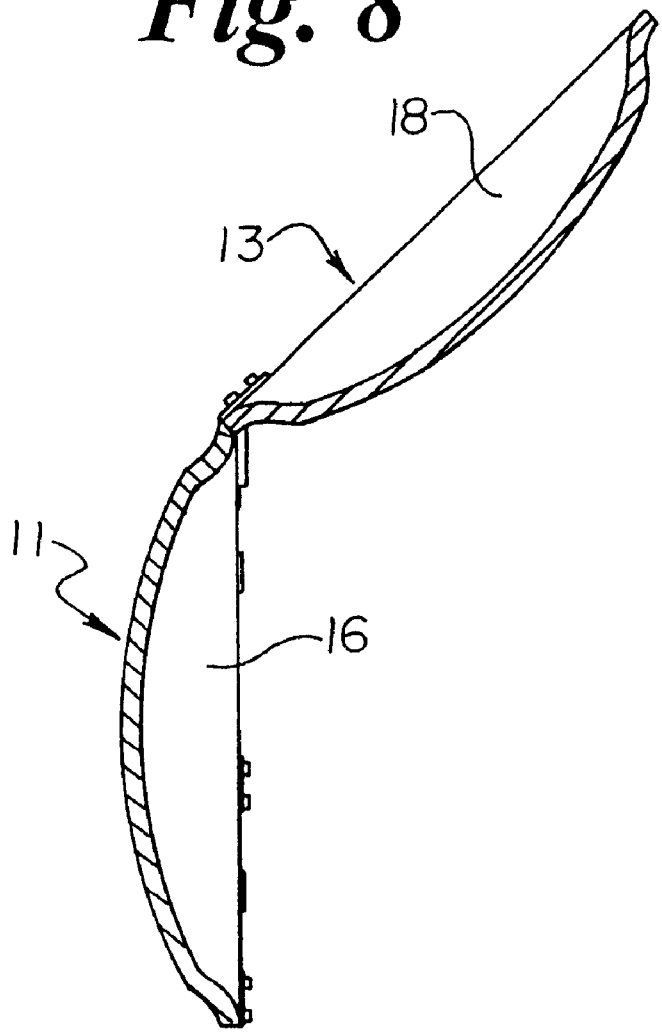
FIG. 8 is a cross-section of the shield in the expanded configuration of FIG. 2, taken along plane ViII—VIII.
Figure 9:
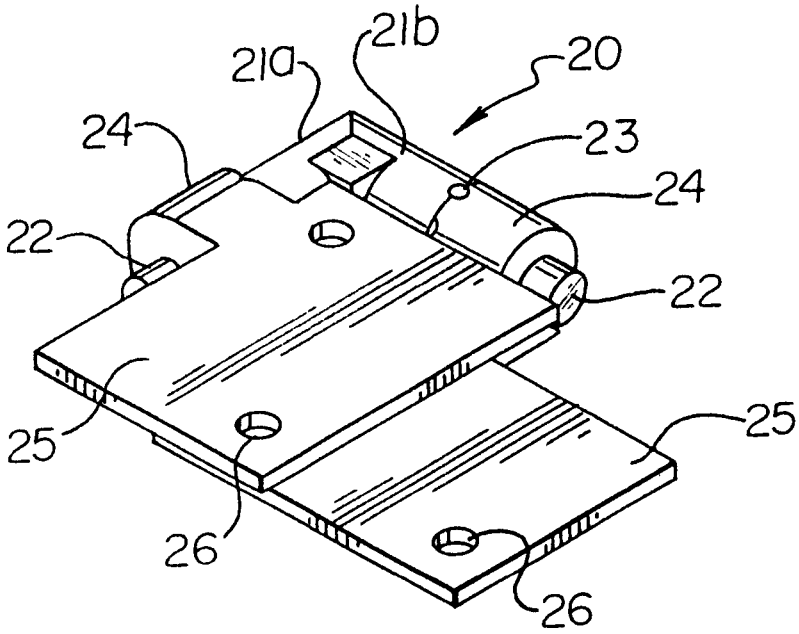
FIGS. 9 and 10 are perspective views, from the front and from the rear respectively, of a hinge according to a preferred embodiment of the invention.
Figure 10:
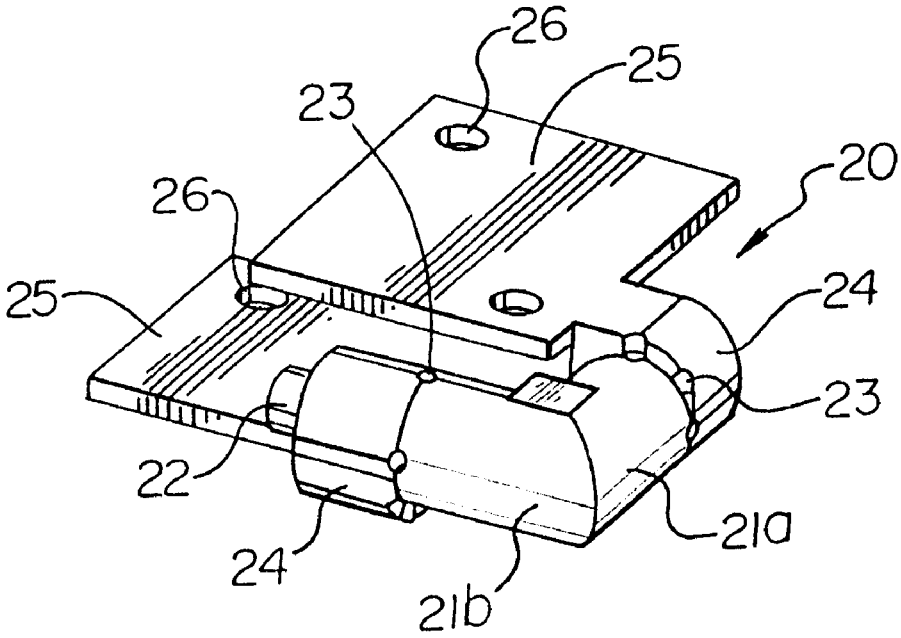
Figure 11:
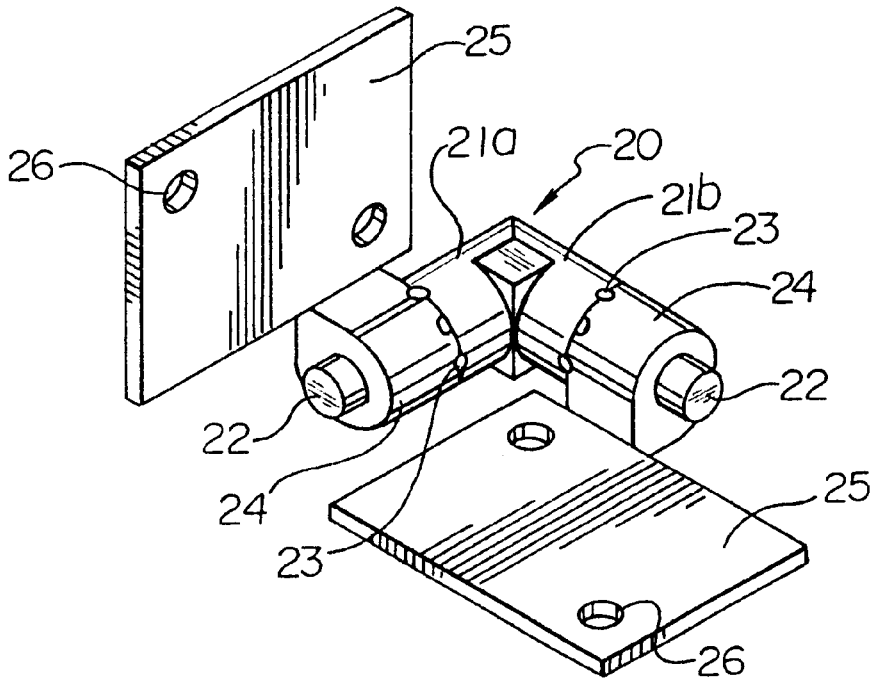
FIGS. 11 to 14 are perspective views of the same hinge, in different angular configurations.
Figure 12:
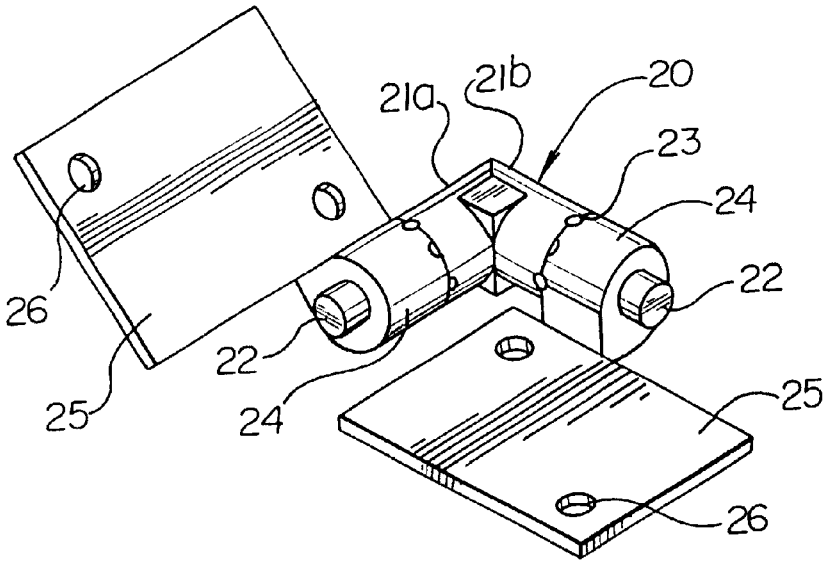
Figure 13:
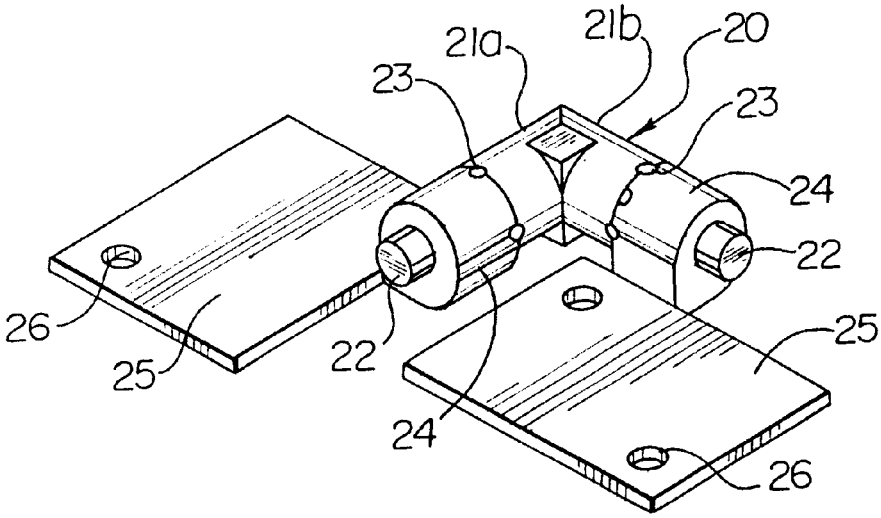
Figure 14:
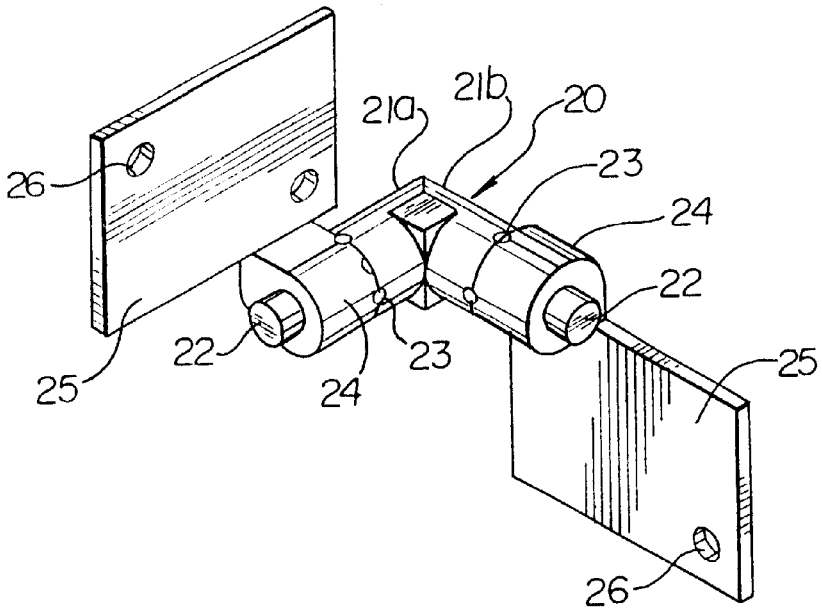
Figure 15:
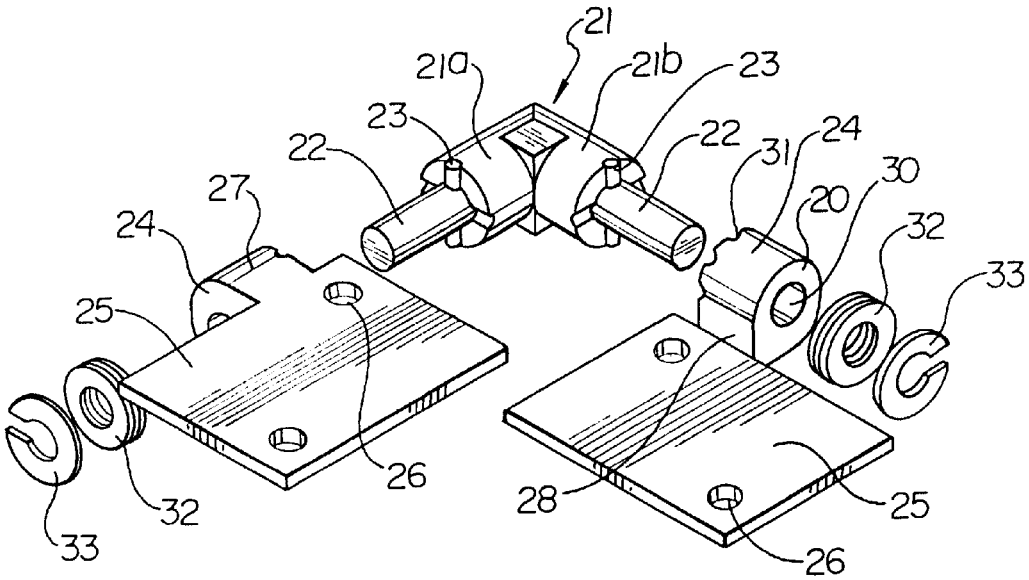
FIG. 15 is an exploded perspective view of the same hinge.

FIGS. 3 and 4 show the shield in folded configuration from the front and from the rear respectively. FIG. 5 is a top view of the shield illustrated in FIG. 4. The top portion of concavity 16 of the central panel is visible in FIG. 5. FIG. 6 is a cross-section of the shield in the folded configuration, taken along plane VI—VI of FIG. 4. FIG. 7 is a top view of the shield illustrated in FIG. 1 in the expanded configuration. FIG. 8 is a vertical cross-section of the shield in a configuration in which the lateral panels are at a slant to the horizontal.

The shield of the invention may include temporary locking means for detachably connecting the two lateral panels with one another and/or to the central panel. Said locking means, not shown, may consist of a pivoted piece having an inverted-U shape, which may be slid over two juxtaposed plates. Other means, however, can easily be provided by skilled persons.

Further, a padding may be provided on the front face of the lateral panels, for avoiding uncomfortable contact with the user's back, when the shield is in the folded configuration. Stays, rotatably connected to the central panel, may be provided for helping to keep the same upright when the shield is an expanded configuration.

The invention also provides a novel structure of hinge, an embodiment of which is illustrated in FIGS. 9 to 15. The hinge is generally indicated at 20, and, as best seen in the exploded perspective of FIG. 15, comprises a corner piece 21, which comprise two branches 21*a* and 21*b* at an angle, preferably a right angle, to one another. From each branch extends a pivot 22, said two pivots being at the same angle from one another as said branches 21*a* and 21*b*. At the end surface of each of said branches, viz. at the root of each of said pivots, are a number of projections angularly spaced from one another. In the embodiment illustrated, the projections are created, at each of said end surfaces, by a plurality of transverse, locking pins 23, one half of which projects from the end surface; and therefore the projections have a half-cylindrical shape. However, the projections could have a different shape. The projections, in this embodiment the locking pins, may be in any desired number, as long as they are so angularly spaced from one another that when one of them engages a serration 31 of a knob 24, to be described, all the other locking pins will concurrently engage other such serrations.

Plates 25 are fixed to the objects that are to be hinged to one another, e.g. by means of screws passing through bores 26. Particularly, in the protective shield hereinbefore described, one of said plates is fixed to central panel 11 and the other to one of the lateral panels 12 or 13. To each plate 25 is connected a knob 24. When the hinge is used pivotally to connect plate-shaped objects, such as said side panels, the knobs 24 are preferably so shaped that one surface 27 thereof is flush with one surface of the corresponding plate 25 and the knob is thick enough to accommodate the connected object, as shown by way of example by flat surfaces 28 against which will bear an edge of a side panel 12 or 13. In any case, skilled persons will easily design the knobs according to the particular use for which the hinge is intended. Each knob has an axial through bore 30, the inner diameter of which corresponds to the outer diameter of a pivot 22, so that said bore will receive said pivot and constitute a seat therefor.

The transverse face of each knob 24 that will contact the center piece 21, which face will be called herein, for the sake of clarity, "the inner end" of the knob, is formed with serrations 31, having a shape matching that of the aforesaid projections. In this embodiment the serrations are semi-cylindrical in shape and have a diameter equal or close to that of the transverse, locking pins 23. When a pivot 22 is housed in bore 30 of knob 24, and this latter is urged towards the center piece and is so rotated that projections 23 engage serration 31, the surface of the inner end of the knob, except the serrations, will abut on the center piece, as shown in FIGS. 9 to 14. In order to urge the knob against the center piece, is provided an elastic means, in this embodiment a spring element, such as a Belleville spring or wave washer/spring 32 and a retaining or C ring 33. The retaining ring is prevented from sliding off the pivot 22 by any suitable means, such as a combination of a pin and groove, which is not illustrated as it can be conventional and easily provided by skilled persons. The elastic means, instead of being located as shown, can be located between the center piece 21 and the knobs 24, in addition to or in place of the locking pins 23. Thus, when the hinge is assembled, the knobs, and with them the plates 25, may assume several angular positions, which are from one another at angular distances that are multiples of the arc spanned by two consecutive serrations 31. In each of said angular positions, the knob 24, and with it the corresponding plate 25, is held by the engagement of the projections 23 with the serrations 31, and cannot move from it except by overcoming the reaction of the elastic means provided. In this way, when the hinge is used in the protective shield hereinbefore described, and the lateral panels are placed in desired angular positions in an expanded configuration of the shield, the weight of said panels is not sufficient to overcome the reaction of said elastic means, and, until sufficient force is applied to overcome it, the lateral panels are held in the desired angular positions.

FIGS. 16 to 19 illustrate a protective shield according to another embodiment of the invention. It comprises a central panel 40, which may be similar to central panel 11 and is carried by the users in the same way, and two lateral panels 41 and 42. The lateral panels, however, are hinged to the central panel along its long or vertical sides and can swing about vertical axes, viz. axes parallel to the long sides of the central panel. The hinges, therefore, have only one degree of liberty. Instead of the hinges illustrated or of any metal or plastic hinges, it is possible to use flexible hinges, e.g. made of fabric. The lateral panels have a width that is preferably about one half of the width of the central panel, and a height that can vary as a matter of design, but is preferably less than that of the central panel and more than one half of it.

The shield further comprises a head piece 46 of flexible, bulletproof material, that comprises a central portion 47, attached to the top of the central panel, and two wings 48–49 attached to sides of said central portion. The central portion could have an essentially rectangular shape, but in this embodiment is shown as having a triangular piece cut off at its center, as shown at 45. The wings have, in the embodiment illustrated, an irregular trapezoidal shape and two flexible handles 43 and 44 to help in positioning them.

Figure 16:
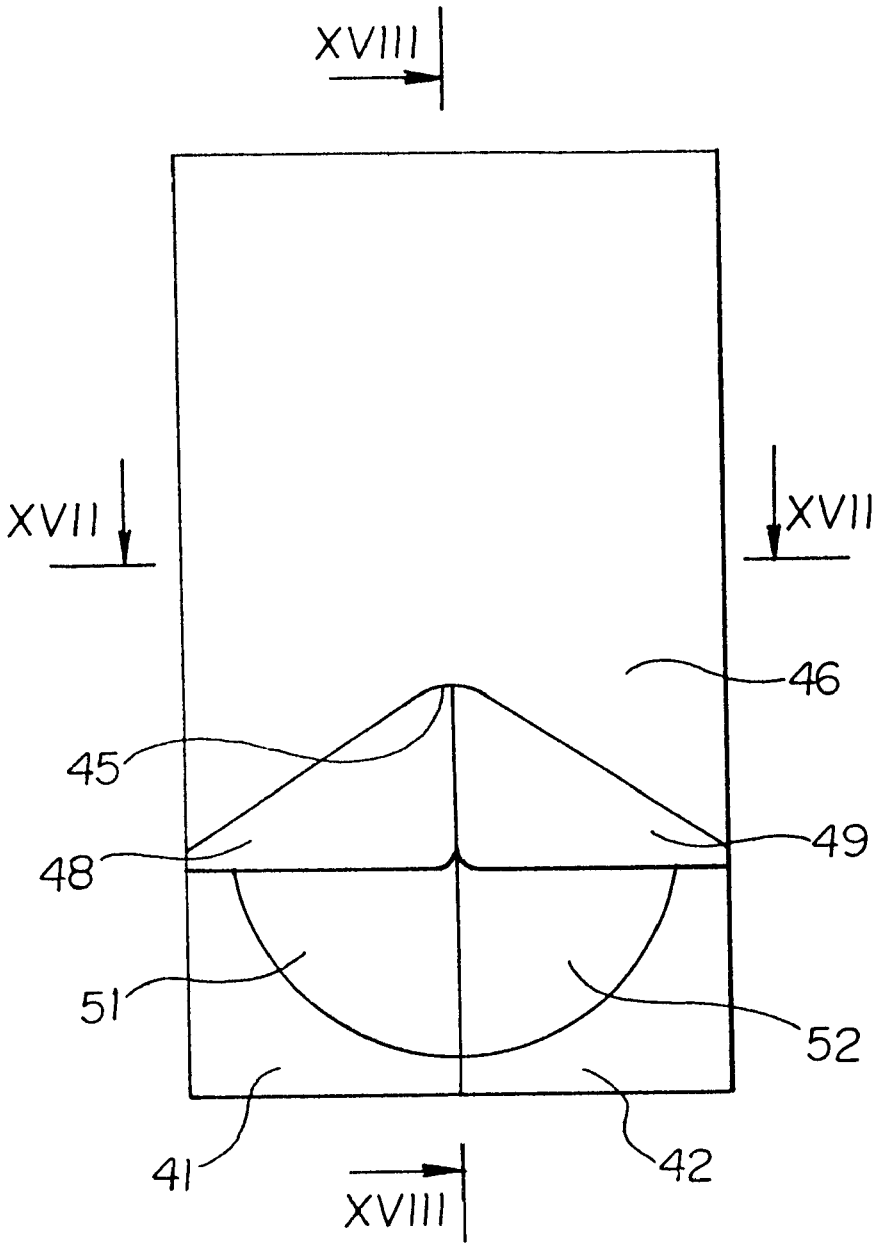
FIG. 16 is a front view of a protective shield according to another embodiment of the invention, in closed configuration.
Figure 17:
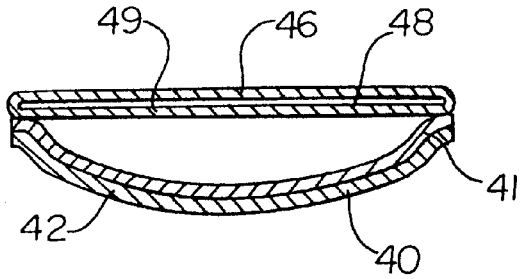
FIG. 17 is a cross-section of FIG. 16, taken on plane XVII—XVII of FIG. 16.
Figure 18:
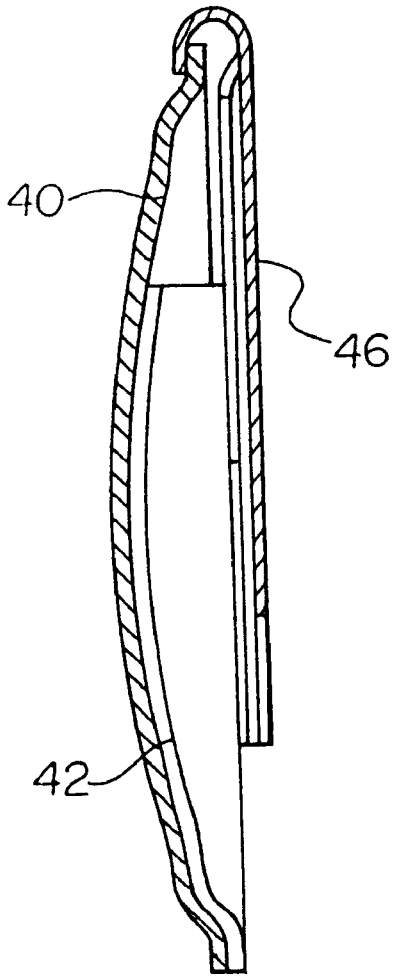
FIG. 18 is a cross-section of FIG. 16, taken on plane XVIII—XVIII of FIG. 16.
Figure 19:
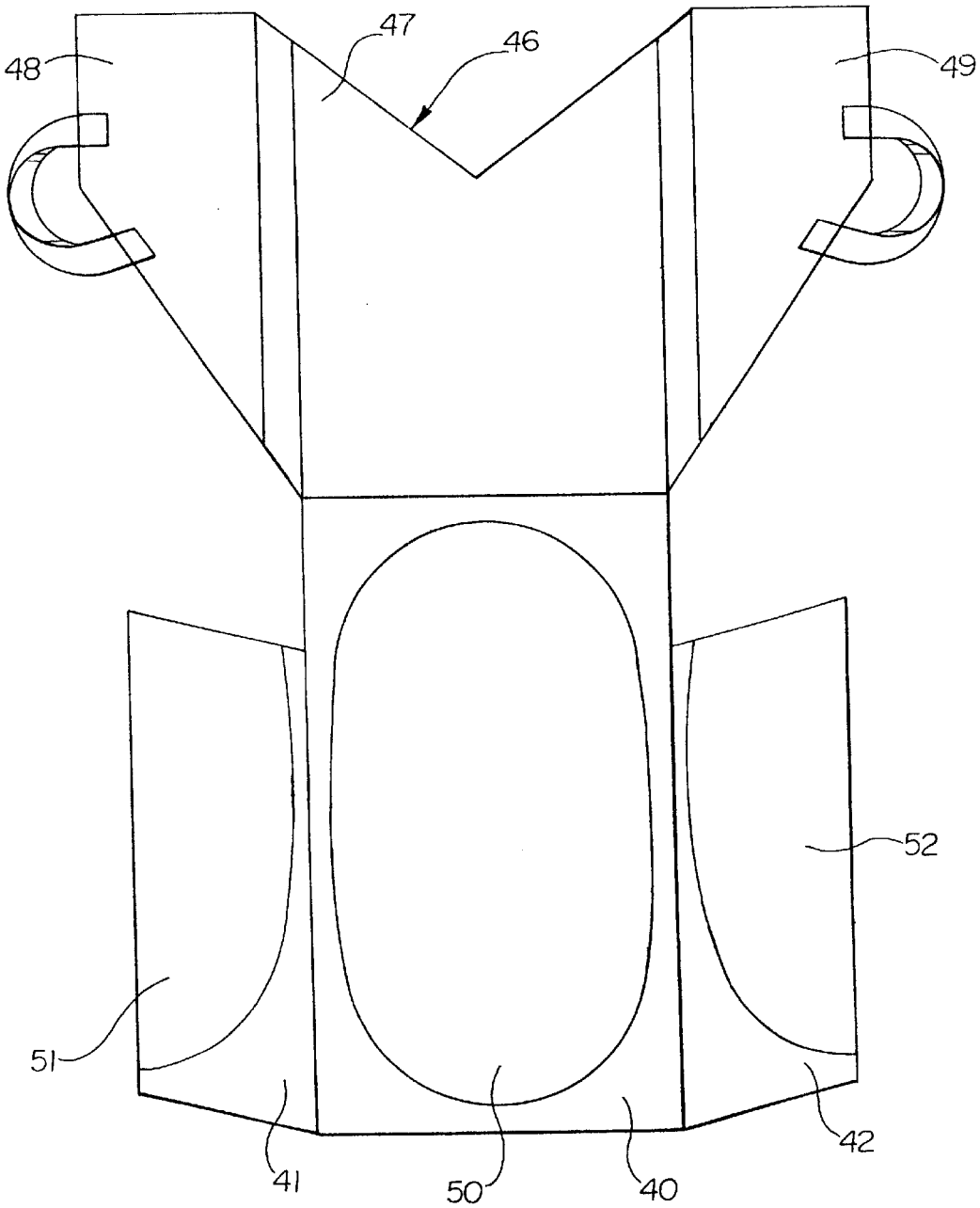
FIG. 19 is a front perspective view of the shield of FIG. 16, in a nearly completely distended configuration.

As in the first embodiment of the invention, the central panel preferably has a curvature matching that of the back of the user, as schematically indicated at 50, and the lateral panels have curvatures matching that of the central panel, as schematically indicated at 51–52, all as in the previously described embodiment. In the folded configuration of the shield, in which configuration it is carried, the lateral panels are parallel to and in abutment with the central panel, the wings of the head piece are folded against its central portion, and the whole head piece is folded down against the central panel and in front of it. The rear of the central panel is therefore free to carry a rucksack or other items of equipment. This configuration is shown in FIGS. 16, 17 and 18. A nearly completely distended configuration—which is not the open or expanded configuration intended to protect the user—is shown from the rear in perspective view, for illustration purposes only, in FIG. 19.

Figure 20:
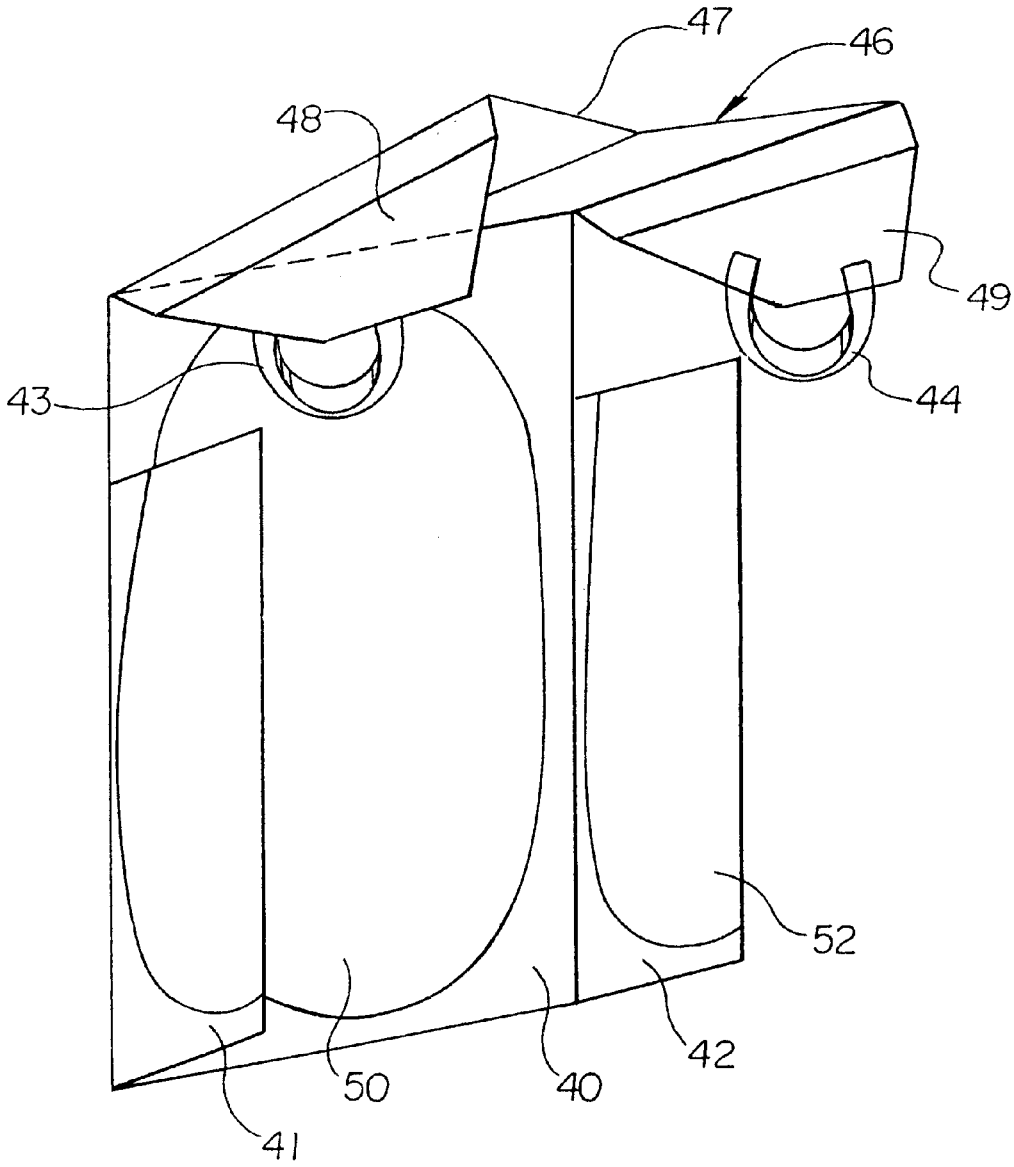
FIG. 20 is a perspective front view of the same shield in open configuration.

The open or expanded configuration intended to protect the user, is shown from the front in perspective view in FIG. 20. The lateral panels 41 and 42 are swung outwardly to protect the sides of the user, generally by about 90°, or by an angle not greatly different from 90°. The head piece 46 is raised so that its center portion is approximately horizontal or (as in FIG. 20) at a limited angle above the horizontal, to protect the top of the user's head, and its wings are swung outwardly to an approximate vertical position to protect the sides of the user's head. The head piece thus assumes a configuration that can be called an inverted-U configuration.

Head piece 46 is preferably made of a few layers of heavy, bullet resistant fabrics or combination of fabrics and/or other flexible materials, and sheets of materials contributing to the resistance to bullets may be inserted therebetween. Suitable types of fabrics are polyethylene, aramid and ceramic fabrics.

Like other embodiments of the invention, the protective shield according to this embodiment is provided with complementary means, such as straps and/or buckles or the like, for facilitating carrying it on the user's back and/or attaching to it a rucksack or other items of equipment. Said complementary means need not be described, since they will be adapted in each case to the manner in which the shield is used, and anyway, are easily provided by expert persons.

The protective shield described, in its various embodiments, is typically an individual shield, adapted to protect a single user. However, a plurality of such shields could be connected or associated to create a protective barrier for a plurality of soldiers or other users.

While specific embodiments of the invention have been described for purposes of illustration, it will be understood that the invention may be carried into practice by skilled persons with many modifications, variations and adaptations, without departing from its spirit or exceeding the scope of the claims.

What is claimed is:

1. Personal protective shield, which comprises:

a)—a central panel;

b)—at least two lateral panels;

c)—hinged connections between said central panel and said lateral panels;

d)—said protective shield having a folded configuration for carrying it and for attaching to it other equipment in which the aforesaid lateral panels are folded against the said central panel, and an expanded configuration for carrying out its protective function, in which the aforesaid lateral panels are angularly set off from said central panel;

e)—the central panel and the lateral panels being of bulletproof plate materials, wherein the central panel has a curved configuration adapted to fit the back of the user, and the lateral panels have curved configurations matching that of the central panel.

2. Personal protective shield, which comprises:

a)—a central panel;

b)—at least two lateral panels;

c)—hinged connections between said central panel and said lateral panels;

d)—said protective shield having a folded configuration for carrying it and for attaching to it other equipment in which the aforesaid lateral panels are folded against the said central panel, and an expanded configuration for carrying out its protective function, in which the aforesaid lateral panels are angularly set off from said central panel;

e)—the central panel and the lateral panels being of bulletproof plate materials, wherein the hinged connections between the central panel and the lateral panels have at least two degrees of liberty, so that the lateral panels, in the expanded configuration, may be set at the sides of the central panel in a vertical position, to protect the sides of the user, or may be set at the top of the central panel in a horizontal position, to protect the user's head.

3. Personal protective shield according to claim 2, which comprises hinges having two degrees of liberty, each of which hinges comprises:

I—a corner piece, comprising two branches, each of which has a pivot extending from, said pivots being at an angle to one another, and having projections angularly spaced from one another located at the ends of the branch;

II—two plates, for rigid connection to two bodies to be hingedly connected to one another;

III—for each plate, a knob solid with or rigidly connected thereto, having a cylindrical seat for one of said pivots and having serrations adapted to be engaged by said projections located at the ends of said branches; and IV—means for elastically retaining said knob against said ends of said branches of said corner piece.

4. Personal protective shield according to claim 1, further comprising locking means for removably connecting the two lateral panels together, when the shield is in the folded configuration.

5. Personal protective shield according to claim 2, wherein the panels are made of bulletproof, substantially rigid, plate material.

6. Personal protective shield according to claim 1, wherein the plate material is a composite material of fibers in a plastic matrix.

7. Personal protective shield according to claim 6, wherein the fibers are chosen from the group consisting of polyethylene, aramide, glass, carbon, and ceramics, and the plastic matrix is chosen from the group consisting of thermosetting resins and thermoplastic resins.

8. Personal protective shield according to claim 7, wherein the thermosetting resins are chosen from the group consisting of epoxy, phenolics, and polyesters and the thermoplastic resins are chosen from the group consisting of polyolefms, polyamides, polyesters, and poly-ether-ether-ketone.

9. Personal protective shield according to claim 6, wherein the plates have a thickness from 3 to 25 mm.

10. Personal protective shield according to claim 1, wherein the central panel has a height from 50 to 80 cm and a width from 30 to 45 cm, and the lateral panels have the same width as the central panel and a height that is one-half that of the central panel.

11. Protective shield according to claim 1, further comprising temporary locking means for detachably connecting the two lateral panels together, when the shield is in the folded configuration.

12. Protective shield according to claim 1, further comprising padding on the front face of the lateral panels, for avoiding uncomfortable contact with the user's back, when the shield is in the folded configuration.

13. Protective shield according to claim 2, which has a plurality of expanded configurations.

14. Protective shield according to claim 2, which further comprises a flexible headpiece connected to the top of the central panel.

15. Protective shield according to claim 14, wherein the hinged connections between the central panel and the lateral panels have one degree of liberty for rotation about axes parallel to the vertical sides of the central piece.

16. Protective shield according to claim 14, wherein each lateral panel has a width equal to one half of the width of the central piece and a length less that that of the central piece.

17. Protective shield according to claim 14, wherein the head piece comprises a central portion, connected to the central panel, and two wings connected to the sides of said central portion.

18. Protective shield according to claim 17, wherein the head piece can be swung with respect to the central panel by an angle of approximately 90° and the wings of said head piece can be swung with respect to the central portion thereof by an angle of approximately 90°, whereby in the expanded configuration of the shield said head piece assumes an inverted-U configuration to protect the head of the user.

19. Protective shield according to claim 14, wherein the head piece comprises two layers of heavy, bullet resistant fabrics.

20. Protective shield according to claim 19, wherein the fabrics are chosen from among polyethylene, aramid and ceramic fabrics.

21. Personal protective shield according to claim 1, wherein the panels are made of bulletproof, substantially rigid, plate material.

22. Protective shield according to claim 1, which has a plurality of expanded configurations.

23. Personal protective shield according to claim 2, further comprising locking means for removably connecting the two lateral panels together, when the shield is in the folded configuration.

24. Personal protective shield according to claim 2, wherein the plate material is a composite material of fibers in a plastic matrix.

25. Personal protective shield according to claim 2, wherein the central panel has a height from 50 to 80 cm and a width from 30 to 45 cm, and the lateral panels have the same width as the central panel and a height that is one-half that of the central panel.

26. Protective shield according to claim 2, further comprising temporary locking means for detachably connecting the two lateral panels together, when the shield is in the folded configuration.

27. Protective shield according to claim 2, further comprising padding on the front face of the lateral panels, for avoiding uncomfortable contact with the user's back, when the shield is in the folded configuration.

* * * * *